US010946502B2

(12) United States Patent
Hohmann et al.

(10) Patent No.: US 10,946,502 B2
(45) Date of Patent: Mar. 16, 2021

(54) POWER SCREWDRIVER

(71) Applicants: Jörg Hohmann, Meschede (DE); Frank Hohmann, Warstein (DE)

(72) Inventors: Jörg Hohmann, Meschede (DE); Frank Hohmann, Warstein (DE)

( * ) Notice: Subject to any disclaimer, the term of this patent is extended or adjusted under 35 U.S.C. 154(b) by 142 days.

(21) Appl. No.: 15/211,118

(22) Filed: Jul. 15, 2016

(65) Prior Publication Data

US 2017/0021480 A1 Jan. 26, 2017

(30) Foreign Application Priority Data

Jul. 16, 2015 (DE) ..... 10 2015 111 570.0

(51) Int. Cl.

| | |
|---|---|
| ***B25B 23/00*** | (2006.01) |
| ***B25B 21/00*** | (2006.01) |
| ***B25F 5/02*** | (2006.01) |
| ***B25F 5/00*** | (2006.01) |

(52) U.S. Cl.

CPC ..... *B25B 23/0078* (2013.01); *B25B 21/00* (2013.01); *B25F 5/001* (2013.01); *B25F 5/02* (2013.01)

(58) Field of Classification Search

CPC ..... B25B 23/0078; B25B 21/00; B23P 19/06; B25H 1/0021; B25H 1/0028; B28B 7/0014; B25F 5/001; B25F 5/02; B25F 5/025

See application file for complete search history.

(56) References Cited

U.S. PATENT DOCUMENTS

| | | | | |
|---|---|---|---|---|
| 1,762,515 A * | 6/1930 | Hiersch | B25B 17/00 475/320 |
| 1,970,179 A * | 8/1934 | Miller | B25B 23/147 192/150 |
| 4,155,278 A | 5/1979 | Estok | |
| 4,462,282 A * | 7/1984 | Biek | B25B 21/00 173/181 |

(Continued)

FOREIGN PATENT DOCUMENTS

| | | | |
|---|---|---|---|
| DE | 4101705 A1 * | 3/1992 | A01G 3/053 |
| WO | 02/085568 | 10/2002 | |
| WO | 2015/036232 | 3/2015 | |

OTHER PUBLICATIONS

Ade et al, DE 4101705 machine translation, 1992 (Year: 1992).*

*Primary Examiner* — Hadi Shakeri
*Assistant Examiner* — Marcel T Dion
(74) *Attorney, Agent, or Firm* — Gudrun E. Huckett

(57) ABSTRACT

A power screwdriver is provided with a drive part having a drive motor, a gear case with gearing elements; an output shaft led out of the gear case; a support offset laterally relative to the output shaft and fixedly connected to the gear case, and a rotary joint with drive-associated ring connected to the drive part and gearing-associated ring connected to the gear case. An actuating ring is arranged coaxially to the output shaft and is movable relative to the drive-associated ring and relative to the gearing-associated ring. It is movable between a release position, in which the rings are rotatable relative to each other, and a blocking position, in which the rings are blocked relative to each other. A spring element acts on the actuating ring over its movement path, extending from blocking position to release position, in the direction of the blocking position.

4 Claims, 2 Drawing Sheets

(56) References Cited

U.S. PATENT DOCUMENTS

| | | | | | |
|---|---|---|---|---|---|
| 4,485,698 | A * | 12/1984 | Adman | B25B 21/008 | 81/57.11 |
| 4,573,370 | A * | 3/1986 | Clemens | B25B 21/00 | 173/218 |
| 5,175,963 | A * | 1/1993 | Schafer | B24B 45/006 | 451/342 |
| 5,692,575 | A * | 12/1997 | Hellstrom | B25B 21/00 | 173/216 |
| 7,011,000 | B2 * | 3/2006 | Kushida | B25B 21/00 | 81/302 |
| 7,220,091 | B2 * | 5/2007 | Takahashi | B24B 45/006 | 411/265 |
| 7,669,507 | B2 * | 3/2010 | Furusawa | B25B 21/00 | 81/475 |
| 7,798,038 | B2 * | 9/2010 | Junkers | B25B 21/008 | 81/57.14 |
| 8,042,434 | B2 * | 10/2011 | Junkers | B25B 23/0078 | 81/467 |
| 8,261,642 | B2 * | 9/2012 | Brandstrom | B25B 21/00 | 173/181 |
| 8,851,201 | B2 * | 10/2014 | Limberg | F16D 7/044 | 173/178 |
| 2007/0021766 | A1 * | 1/2007 | Belagali | A61B 17/1622 | 606/180 |
| 2010/0229691 | A1 * | 9/2010 | Brandstrom | B25F 5/025 | 81/57.11 |
| 2013/0133908 | A1 * | 5/2013 | Schenk | B25B 21/00 | 173/47 |
| 2014/0274548 | A1 * | 9/2014 | Kelleher | F16D 7/00 | 475/293 |
| 2016/0059401 | A1 * | 3/2016 | Ikuta | B25F 5/001 | 173/164 |

* cited by examiner

POWER SCREWDRIVER

BACKGROUND OF THE INVENTION

The invention relates to a power screwdriver, with a drive part having a drive motor, a gear case with gearing elements and an output shaft led out of the gear case, a support which is arranged offset laterally with respect to the output shaft and is fixedly connected to the gear case, and a rotary joint comprising a drive-associated ring connected to the drive part and a gearing-associated ring connected to the gear case.

In the case of power screwdrivers of this type, the drive part comprises a drive motor, a handle, and a switching device. During the screwing operation, the operator holds the power screwdriver by the handle. If, as described in U.S. Pat. No. 4,155,278, the drive part and therefore also the handle are rotatable relative to the gear case in individual latching positions with respect to one another, the drive part can rotate in relation to the gear case after the power screwdriver is placed onto a screw connection. As a result, after the power screwdriver is placed onto a screw connection, the drive part can be brought into a more favourable operating position in which the position of the handle is more comfortable for the operator.

WO 02/085568 A1 discloses a power screwdriver in which, because of a rotary joint which is lockable by means of a switch button of the drive part, the driver does not have to apply the torque which occurs in the dividing plane of the rotary joint during the screwing operation as a holding torque. However, the structural outlay associated therewith is relatively high.

A power screwdriver of the aforementioned kind is known from WO 2015/036232 A1. In the case of this power screwdriver, the drive part is also connected to the gear case via a rotary joint, and therefore the drive part is in principle rotatable in relation to the gear case. A fixing device is also part of the rotary joint. Said fixing device is provided on the outside with a switching ring via which the fixing device is actuable for blocking and for releasing the rotary joint. For this purpose, the switching ring is lockable either in the blocking position or in the release position by means of a locking device.

Upon locking in the release position, a subsequently arising tightening torque cannot be dissipated via the support to adjacent machine parts as abutment. Depending on the situation, there is the risk of the drive part beginning to rotate and to pulsate about its axis. This may result in a hazard for the operator.

SUMMARY OF THE INVENTION

It is therefore the object of the present invention to provide a power screwdriver of the aforementioned kind which permits specific rotatability of the drive part in relation to the gear case with simultaneously high operating safety.

In order to achieve this objet, the power screwdriver according to the invention comprises:

- a drive part having a drive motor,
- a gear case with gearing elements and an output shaft extending out of the gear case,
- a support which is arranged offset laterally with respect to the output shaft and is fixedly connected to the gear case,

- a rotary joint consisting of a drive-associated ring connected to the drive part and a gearing-associated ring connected to the gear case,
- an actuating ring which is arranged coaxially with respect to the output shaft and is arranged movably in relation to the drive-associated ring and in relation to the gearing-associated ring and is movable between a release position, in which the rings are rotatable with respect to each other, and a blocking position, in which the rings are locked in relation to each other,
- a spring element which acts upon the actuating ring along its movement path, extending from the blocking position to the release position, in the direction of the blocking position.

The power screwdriver has a drive part with a drive device. Separated therefrom, said power screwdriver has a gear case, wherein the gear case has a torque converter in the manner of a gearbox and an output shaft, which gearbox and output shaft transmit the rotational movement of the drive device. The drive part is connected to the gear case via a rotary joint, and therefore the drive part is in principle rotatable in relation to the gear case if a blocking element does not block the parts with respect to one another. Also present is an actuating ring which is arranged coaxially with respect to the output shaft and is arranged movably in relation to the drive-associated ring and in relation to the gearing-associated ring. Said actuating ring is movable between a release position, in which the rings are rotatable with respect to one another, and a blocking position, in which the rings are blocked in relation to one another.

By means of a spring element which acts in the direction of the blocking position on the actuating ring along its entire movement path, which extends from the blocking position to the release position, the blocking element always returns automatically into that blocking position in which the blocking element blocks the two rings, i.e. the drive-associated ring and the gearing-associated ring, relative to each other. There is therefore no risk to the operator that, when the power screwdriver is started up, the rotary joint is unintentionally situated in the release position, for example, because said rotary joint is locked, and therefore the entire reaction torque acts on the handle of the drive part and an uncontrolled rotation of the power screwdriver about its own axis occurs.

On the other hand, the effect achieved by the rotary joint is that the drive part in principle remains rotatable in relation to the gear case, and therefore, after the power screwdriver is placed onto a screw connection, the drive part can be rotated into a favourable operating position. This operating position is a rotational position of the drive part that is comfortable and safe for the operator. After this operating position is set, the rotary joint automatically blocks, and therefore, during the subsequent screwing operation, a torque which would have to be counteracted by the operator does not occur in the dividing plane of the rotary joint. The screwing operation can therefore always be carried out safely and without the risk of faulty operation.

For the power screwdriver, a drive device may be used which applies a greater torque compared to the customarily used universal motors. For example, it is possible to use a commercially available battery-operated drill screwdriver which generates a torque of up to 60 Nm as the drive part of the power screwdriver according to the invention. Even then, the power screwdriver is usable in a comfortable manner for the operator, wherein a high degree of safety for the operator during the screwing operation is ensured at the same time.

According to an embodiment of the power screwdriver, at least one compression spring or tension spring serves as a load element. It is also possible to arrange more than one compression spring or tension spring, for example, two or three compression springs or tension springs, about the circumference of the rotary joint. The advantage of this embodiment resides in the compact construction in which the diameter of the power screwdriver is not significantly increased in the region of the rotary joint.

BRIEF DESCRIPTION OF THE DRAWINGS

Further details and advantages of the invention can be taken from the following description of the attached drawings in which an exemplary embodiment of the power screwdriver according to the invention is illustrated.

DESCRIPTION OF PREFERRED EMBODIMENTS

Figure 1:
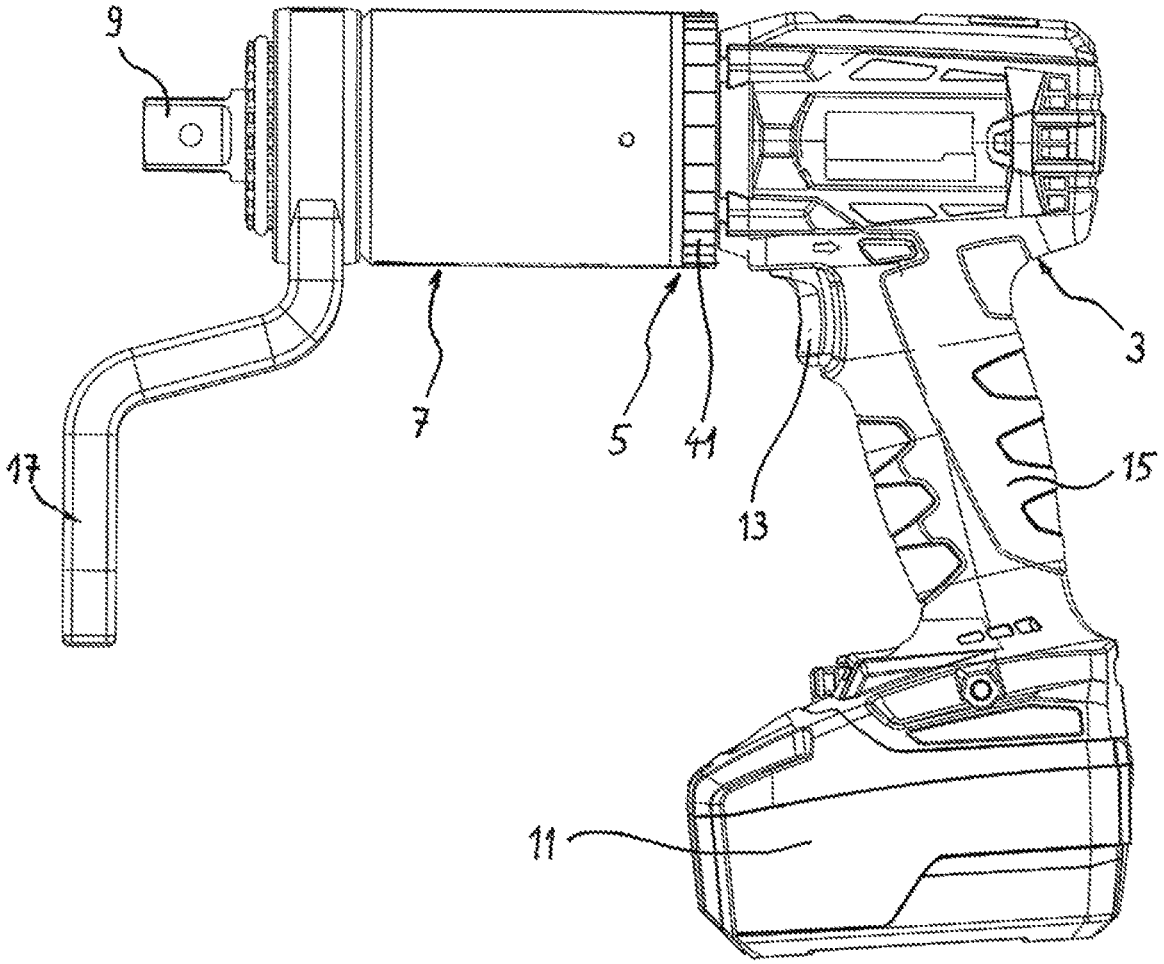
FIG. 1 shows a schematic side view of a power screwdriver.

FIG. 1 shows a power screwdriver in a side view. Said power screwdriver has a drive part 3 which comprises a drive device, for example, an electric motor. The drive part 3 is connected to the gear case 7 of a gear box via a rotary joint 5. The interior of the gear case 7 contains various rotary bearings for a torque converter, for example a planetary gearing composed of gearing elements, and for an output shaft 9 which has an end with a polygonal profile that projects from the gear case 7. A key nut can therefore be placed onto the output shaft 9.

The drive part 3 has an energy store 11 for electrical energy, for example an accumulator (battery pack) which supplies the drive device, which is in the form of an electric motor, with electrical energy. As a result, the power screwdriver 1 according to the invention is operable independently of a power network.

The drive part 3 can likewise also contain a motor which is supplied with electrical energy via an electric connecting cable, if said motor operates at a sufficiently high initial torque.

The drive is controllable via a switch 13. Furthermore, the drive part 3 has a handle 15 which protrudes to the side and via which the operator can hold the power screwdriver 1 and can handle it up to the beginning or during the screwing process.

By means of the planetary gearing in the gear case 7, the torque generated by the drive device of the drive part 3 is reinforced and transmitted to the output shaft 9.

A rigid support 17, via which the gear case 7 and therefore the power screwdriver 1 can be supported during operation against a positionally fixed machine part (not illustrated) in the form of an abutment, is attached to the side of the gear case 7.

The drive part 3 is connected rotatably to the gear case 7 via the rotary joint 5, which is arranged coaxially with respect to the output shaft 9. The power screwdriver 1 can thereby be placed in an advantageous manner onto a screw connection, wherein the drive part 3 can subsequently be rotated into an operating position which is comfortable for the operator. For example, it is possible to place the power screwdriver 1 onto a screw connection and subsequently to carefully actuate the drive device. The gear case 7 can rotate in relation to the drive part 3 because of the rotary joint 5. It may also be helpful that, when the drive part is switched on, the gear case 7 rotates about its longitudinal axis and slowly pivots the support 17 until the latter butts against a positionally fixed abutment. Only then is the rotary joint 5 blocked. This is because the rotary joint 5 has a fixing device via which the rotary joint 5 is blockable automatically, i.e. without active intervention by the operator. This prevents the initial torque in the dividing plane of the rotary joint 5 from being transmitted to the operator as a consequence of a faulty operation.

Figure 2:
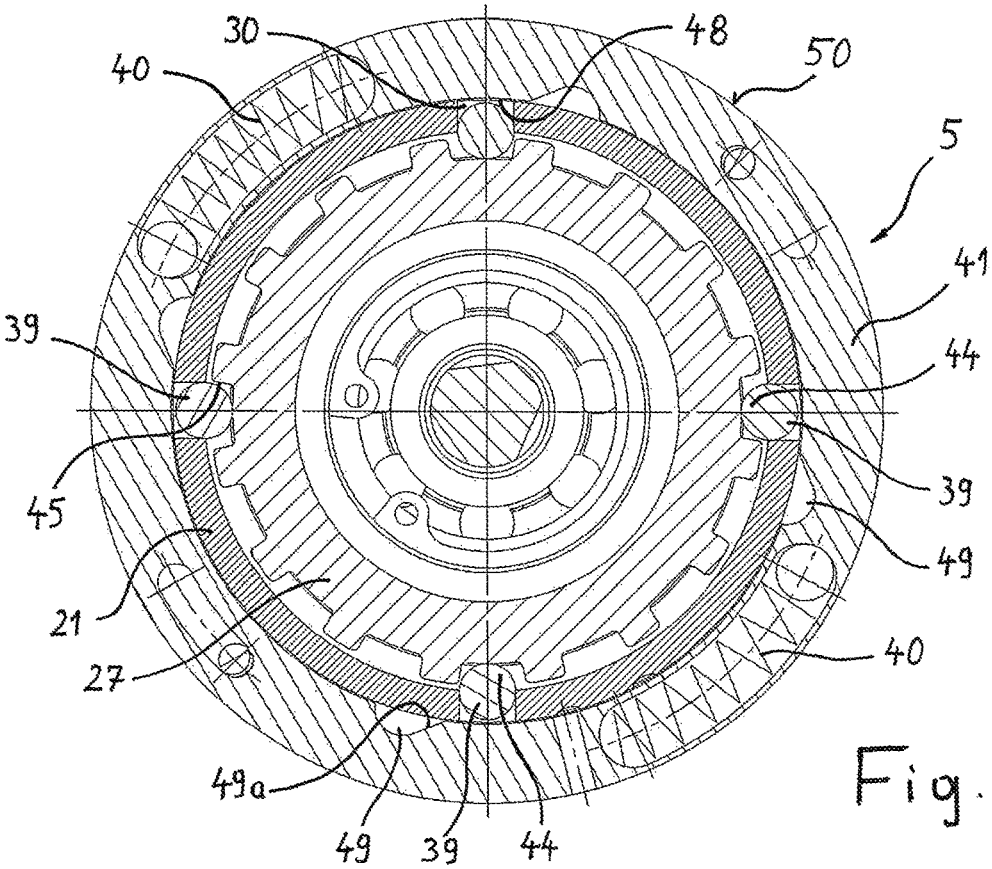
FIG. 2 shows a sectional illustration in the region of the rotary joint of the power screwdriver, wherein the blocking position is shown.

FIG. 2 illustrates the rotary joint 5 in cross section. The rotary joint 5 consists of a first ring 21 which is connected non-rotatably and preferably rigidly to the drive part 3 and in particular to the housing thereof. A second ring 27 is mounted rotatably in the first ring 21. The second ring 27 is connected non-rotatably and preferably rigidly to the gear case 7 of the gearing part.

A fixing device is active between the first ring 21 and the second ring 27 and always automatically returns again into its active position, although it can be deactivated by hand.

For this purpose, one of the two rings 21, 27, here the drive-associated ring 21, is provided with openings 30 or recesses in which balls 39 which serve as blocking elements are situated. At the same time, the other of the two rings 21, 27, here the gearing-associated ring 27, is provided with depressions 32 distributed uniformly over its circumference. Said depressions 32 have blocking counter surfaces 45 in which the blocking elements 39, here the respectively inner half shell 44 of a ball, can engage in order to block thereby the two rings 21, 27 in relation to each other in the circumferential direction by a form-fitting connection and thus to block the rotary joint 5.

The blocking elements 39 are blocked by the exertion of pressure on the blocking elements 39. An actuating ring 41 which is permanently acted upon by spring force produces said pressure. FIG. 2 illustrates an actuating ring 41 which is acted upon in the direction of rotation by two compression springs 40 of identical design. The actuating ring 41, like the two rings 21, 27, is arranged coaxially with respect to the output shaft 9, and the axis of rotation of said actuating ring 41 coincides with the output shaft 9.

A plurality of balls serving as blocking elements 39 are provided over the circumference of the rotary joint; four balls total in the exemplary embodiment are provided. Each ball 39 is situated in an opening 30 of the first ring 21, wherein the opening 30 matches the size of the ball in the circumferential direction or is only slightly larger than the ball.

The diameter of the balls 39 is larger than the radial thickness of the first ring 21 so that each ball 39 protrudes radially outwards past the ring 21 and/or protrudes radially inwards past the ring 21.

In the blocking position of the rotary joint 5 that is shown in FIG. 2, the balls 39 protrude radially inwards, wherein the inwardly pointing half shell 44 of each ball extends into the corresponding depression 32 and is supported in a form-fitting manner against the blocking counter surface 45 when a torque is applied. As a result, the first ring 21 is blocked in relation to the second ring 27.

Figure 3:
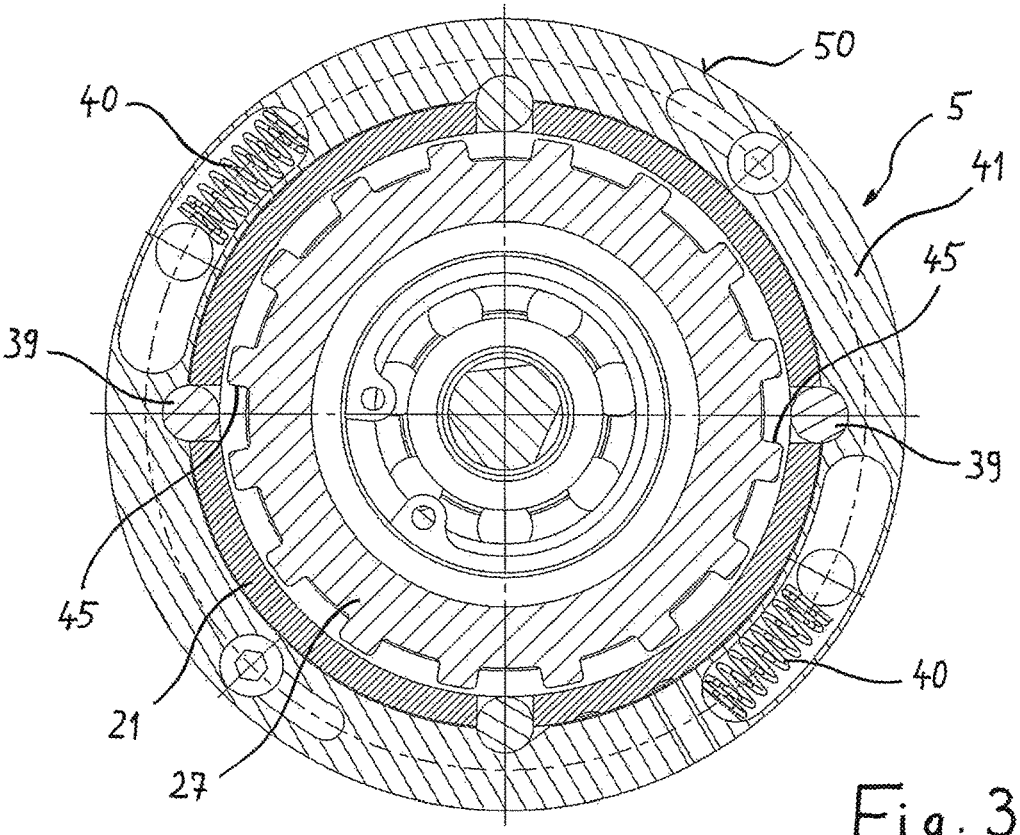
FIG. 3 shows a sectional illustration in the region of the rotary joint of the power screwdriver, wherein the release position is shown.

In the release position of the rotary joint 5 that is shown in FIG. 3, the balls 39 can yield outward and then assume a position that is lying further outwards radially. Their outwardly pointing half shells are located here in a release portion 49 on the inner side of the actuating ring 41. A blocking portion 48 which is likewise located on the inner side of the actuating ring adjoins each release portion 49 in the circumferential direction of the actuating ring 41. The release portion 40 is situated on a larger radius than the blocking portion 48.

When the actuating ring 41 is rotated in the circumferential direction, either the blocking portion 48 or the release portion 49 hits the outer side of the respective balls 39. The balls can therefore either yield outwards such that no blocking takes place between the two rings 21, 27 (FIG. 3) or said balls are held in their radially inwardly located position in which the balls 39 act as blocking elements and block the two rings 21, 27 relative to each other in the circumferential direction (FIG. 2).

Locking takes place only in one of said two positions, namely in the blocking position according to FIG. 2, in which each ball 39 engages inwardly the blocking counter surface 45 and is supported outwardly against the blocking portion 48. This is because, owing to the action of the spring element 40, the actuating ring 41 is automatically held in said blocking position and to this extent is blocked.

In order to release the blocking position, the actuating ring 41 has to be actively rotated counter to the force of the compression springs 40 without said actuating ring locking when it reaches the other end position, i.e. the release position. This non-locking in the release position has the consequence that, after the actuating ring 41 is released, the latter immediately snaps back again into the blocking position because of its permanent spring loading, whereby the blocking elements 39 are pressed inwards until they again block the two rings 21, 27 in relation to each other in the circumferential direction. This is facilitated when the release portion 49 merges via a ramp 49*a* into the blocking portion 48.

For facilitated rotation of the actuating ring 41 into its release position, the outer side of the actuating ring 41 is provided with ribbing 50 which increases grip.

The specification incorporates by reference the entire disclosure of German priority document 10 2015 111 570.0 having a filing date of Jul. 16, 2015.

While specific embodiments of the invention have been shown and described in detail to illustrate the inventive principles, it will be understood that the invention may be embodied otherwise without departing from such principles.

LIST OF REFERENCE NUMBERS

1 Power screwdriver
3 Drive part
5 Rotary joint
7 Gear case
9 Output shaft
11 Energy store
13 Switch
15 Handle
17 Support
21 First ring
27 Second ring
30 Opening
32 Depression
39 Blocking element, ball
40 Spring element
41 Actuating ring
44 Blocking surface, half shell of the ball
45 Blocking counter surface
48 Blocking portion
49 Release portion
49*a* Ramp

What is claimed is:

1. A power screwdriver, comprising
a drive part comprising a drive motor,
a gear case;
gearing elements arranged in the gear case;
an output shaft connected to the gearing elements and extending out of the gear case;
a support arranged offset laterally relative to the output shaft and fixedly connected to the gear case;
a rotary joint comprised of a drive-associated first ring connected to the drive part and a gearing-associated second ring connected to the gear case;
an actuating ring arranged coaxially to the output shaft and arranged movably relative to the first ring and relative to the second ring, wherein the first ring and the second ring are arranged coaxially to the output shaft and to the actuating ring, wherein the actuating ring is movable along a movement path extending between a release position, in which the first and second rings are rotatable relative to each other, and a blocking position, in which the first and second rings are blocked relative to each other;
wherein the actuating ring comprises an outer side provided with a ribbing that increases grip;
a spring element acting on the actuating ring along the movement path in a direction toward the blocking position;
at least one blocking element arranged in a dividing plane of the rotary joint so as to be radially movable, wherein the actuating ring comprises a blocking portion, wherein the at least one blocking element is radially moved against the blocking portion and radially supported against the blocking portion only in the blocking position and blocks in the blocking position a rotation of the first and second rings relative to each other, and wherein the at least one blocking element, in the release position, is radially moved away from the blocking portion so that the first and second rings are rotatable relative to each other;
wherein the at least one blocking element engages a blocking counter surface on an outer surface of the first ring or of the second ring only in the blocking position;
wherein the at least one blocking element is a ball comprising a half shell that engages the blocking counter surface and comprising a circumferential portion that is facing away from the half shell and is supported against the blocking portion.

2. The power screwdriver according to claim 1, wherein the actuating ring is configured to rotate relative to the first ring and relative to the second ring.

3. The power screwdriver according to claim 1, wherein the blocking portion is located on an inner side of the actuating ring.

4. The power screwdriver according to claim 3, wherein the actuating ring comprises a release portion adjoining the blocking portion in a circumferential direction of the actuating ring, wherein the release portion is arranged on a first radius and the blocking portion is arranged on a second radius, wherein the first radius is larger than the second radius.

* * * * *